United States Patent [19]

Sato

[11] Patent Number: 4,542,547

[45] Date of Patent: Sep. 24, 1985

[54] PNUEMATIC MAT WITH SENSING MEANS

[75] Inventor: Hisashi Sato, Gunma, Japan

[73] Assignee: Hiroshi Muroi, Tokyo, Japan; a part interest

[21] Appl. No.: 561,464

[22] Filed: Dec. 14, 1983

[30] Foreign Application Priority Data

Dec. 15, 1982 [JP] Japan ..... 57-189597[U]

[51] Int. Cl.[4] ..... A47C 27/10; A61G 7/04

[52] U.S. Cl. ..... 5/453; 5/447; 5/456

[58] Field of Search ..... 5/446, 447, 449, 453, 5/455, 456

[56] References Cited

U.S. PATENT DOCUMENTS

| | | | |
|---|---|---|---|
| 2,415,150 | 2/1947 | Stein | 5/455 |
| 3,330,598 | 7/1967 | Whiteside | 5/453 |
| 3,363,941 | 1/1968 | Wierwille | 5/456 |
| 3,879,776 | 4/1975 | Solen | 5/447 |
| 3,919,730 | 11/1975 | Regan | 5/456 |
| 3,982,786 | 9/1976 | Burgin | 5/455 |
| 4,394,784 | 7/1983 | Swenson et al. | 5/455 |

*Primary Examiner*—Gary L. Smith
*Assistant Examiner*—Michael F. Trettel
*Attorney, Agent, or Firm*—Steinberg & Raskin

[57] ABSTRACT

A mat unit for a bed may be selectively inflated or deflated, to change the posture of an individual lying on the bed, in a natural and gentle manner. A plurality of such mat units may make up a bed. Selective inflation and/or deflation of any number of these mat units may be controlled to change the posture of, and even turn over, an individual who is seriously handicapped or extremely bedridden.

10 Claims, 11 Drawing Figures

PNUEMATIC MAT WITH SENSING MEANS

BACKGROUND OF THE INVENTION

The present invention relates generally to a bed and a mat unit for use thereon and, more particularly, to a mat unit for a bed which enables the physically handicapped or, in serious cases, one who has difficulty moving in bed without assistance, to lie on his side or back, roll on his side, or raise the upper half of his body, by operating a control device.

The present invention also relates to a bed on which these mat units are used, and to a method for adjusting the position of a bedridden individual.

A variety of beds suitable for the physically handicapped or those confined to bed, have been suggested. However, in the use of these beds, the services of a helper or nurse are generally required to assist the individual in lying down or in rolling over, in bed. However, a bedridden individual is often forced to lie in bed continuously, and can thereby suffer severe pain at night, or while the helper or nurse is absent.

Other kinds of beds have been suggested, such as beds which are transversely slanted or raised in a front portion or rear portion, by mechanical means. However, the patient lying therein will generally be less comfortable than when he is taken care of through human intervention, so that this is inadequate for use in seriously bedridden cases.

Another kind of bed has also been suggested, in which the upper surface of the bed is divided into a plurality of units, each unit adapted to be mechanically, vertically movable, using a motor as a drive source or using a hydraulic cylinder provided in each unit. In such beds, selective adjustable differences in the levels of respective portions of the bed are caused by mechanical adjustment. However, since surface levels of the units are quite different from one another, forming mechanical unevenness along the overall surface of the bed, a bedridden individual is often forced to lie on the bed in an extremely uncomfortable position, until someone comes along to readjust the position of the bed. Therefore, such a type of bed is hardly fit for seriously bedridden individuals.

SUMMARY OF THE INVENTION

Accordingly, it is an object of the present invention to provide a new and improved mat unit for a bed which can be easily and conveniently adjusted to fit the contours of an individual lying thereon.

It is also an object of the present invention to provide a new and improved bed constituted of a plurality of such mat units, which can be easily and conveniently adjusted to fit the contours of an individual lying thereon.

It is a further object of the present invention to provide a new and improved mat unit for a bed, and to provide a new and improved bed constituted by a plurality of such mat units, which constitute an improvement over conventional units or beds of the types such as disclosed in the background of the present invention.

It is still another object of the present invention to provide a new and improved mat unit for a bed, and to provide a new and improved bed constituted of a plurality of such mat units, which can comfortably accommodate a seriously bedridden individual.

It is a still further objection of the present invention to provide a new and improved mat unit for a bed, and provide a new and improved bed constituted of a plurality of such mat units, which can be easily adjusted by a bedridden individual himself.

These and other objects are attained by the present invention, which provides a mechanism in which a plurality of mat units are fixedly provided adjacent to each other on a bed base, with individual mat units being inflated or deflated by a control device to required levels or positions, to change the posture or position of an individual lying in bed, automatically in a natural and gentle manner.

According to the present invention, each of the individual mat units is formed as a bellows-type structure. Each bellows of an individual mat unit may freely and flexibly undulate along the upper surface of the bed when contacting any portion of the body of an individual lying in bed. Because of this structure, the individual mat units and the bed of the present invention are able to fit the contours of the body of an individual quite naturally, being far more comfortable for the individual than a conventional bed type in which the bed surface is vertically moved by a mechanical device as noted above (please see FIG. 5 for an illustration of the operation of the present invention).

The present invention provides an individual mat unit comprising a substantially air-tight, hollow bellows, an air feeding pipe connected to the bellows at one end thereof, a valve connected to the air feeding pipe to control the air quantity to be fed to the bellows, an exhaust pipe connected to the bellows at one end and open to the atmosphere at its other end, a valve connected to the exhaust pipe to control the air quantity discharged from the bellows, and a supply source of pressurized air.

The present invention further provides a bed comprising a base and a plurality of such mat units fixed to the base, each mat unit constituted of the structure described above.

In a preferred embodiment of the present invention, the mat unit is further provided with a sensing mechanism for detecting air quantity in the bellows.

An example of the sensing mechanism described above is a structure composed of a suspending piece depending from the upper end of the bellows, a photoelectric sensor provided on the suspending piece, and a plurality of reflective members disposed in positions capable of lying opposite to the photoelectric sensor, situated on the outer side of the bellows at predetermined intervals.

Another example of the sensing mechanism is a structure comprising a receiving table provided on an inner bottom of the bellows, a photoelectric sensor provided on a side of the receiving table, and a plurality of reflective members disposed in positions adapted to lie opposite the photoelectric sensor on an inner side of the bellows, at predetermined intervals.

Furthermore, each bellows may be provided with a sensor for sensing contact of the bellows with the body of an individual lying thereover, and therefore adapted to detect the posture of the individual lying on the bed.

BRIEF DESCRIPTION OF THE DRAWINGS

The present invention will be described in greater detail, with reference to the accompanying drawings, in which.

DETAILED DESCRIPTION OF THE PREFERRED EMBODIMENTS

Figure 1:
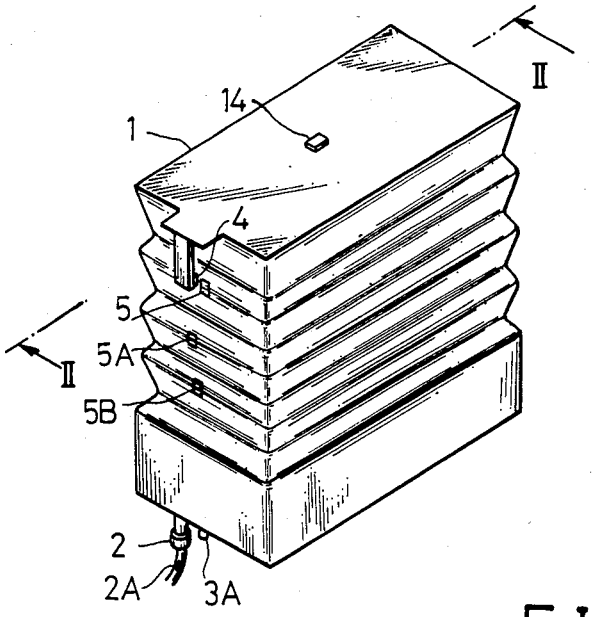
FIG. 1 is a perspective view of a mat unit embodiment of the present invention.

Referring to the accompanying drawings, notably the embodiment illustrated in FIGS. 1–5, one of a plurality of mat units 1 forming a mat body 20 is illustrated in FIG. 1, mat unit 1 being shaped as a bellows in its upper portion thereof, the bellows made of flexible material such as a synthetic rubber, synthetic resin, or waterproof fabric, and being inflated or deflated by air blown thereinto or discharged therefrom.

Mat unit 1 is provided with a known electromagnetic valve 2 controlled by a control device 6, for example a computer, for feeding air from compressor 10 into mat unit 1 or for stopping this feeding of the air, the electromagnetic valve 2 being connected to an air feeding pipe 2*a* for feeding air into mat unit 1. One end of feeding pipe 2A is connected to mat unit 1, and its other end is connected to the compressor 10.

Mat unit 1 is further provided with an electromagnetic valve 3 controlled by control device 6, either to discharge air from mat unit 1 or to stop air from discharging, electromagnetic valve 3 being connected to an exhaust pipe 3A. Exhaust pipe 3A is connected to mat unit 1 at one end thereof, and opened to the atmosphere at its other end.

Photoelectric sensor 4 is provided on suspending piece 4A which in turn depends from an upper end of mat unit 1. Photoelectric sensor 4 detects positions of reflective members 5, 5A and 5B provided on bulging parts of the bellows-shaped mat unit 1, in order to detect air quantity in mat unit 1. Photoelectric sensor 4 transmits electric signals to electromagnetic valves 2 and 3 through the control device 6, to adjust air quantity in mat unit 1 and thereby adjust the height of mat unit 1.

A sensor 14, for sensing contact of a body with the mat unit 1 itself, is provided on a top surface of mat unit 1 so that posture of an individual lying on mat body 20 can be detected by establishing electrical communication from sensor 14 to control device 6. A program of supply and discharge of air into and out of mat unit 1 is inputted beforehand into control device 6, which may be a computer for example, for instructing electromagnetic valves 2 and 3 to operate.

Figure 3:
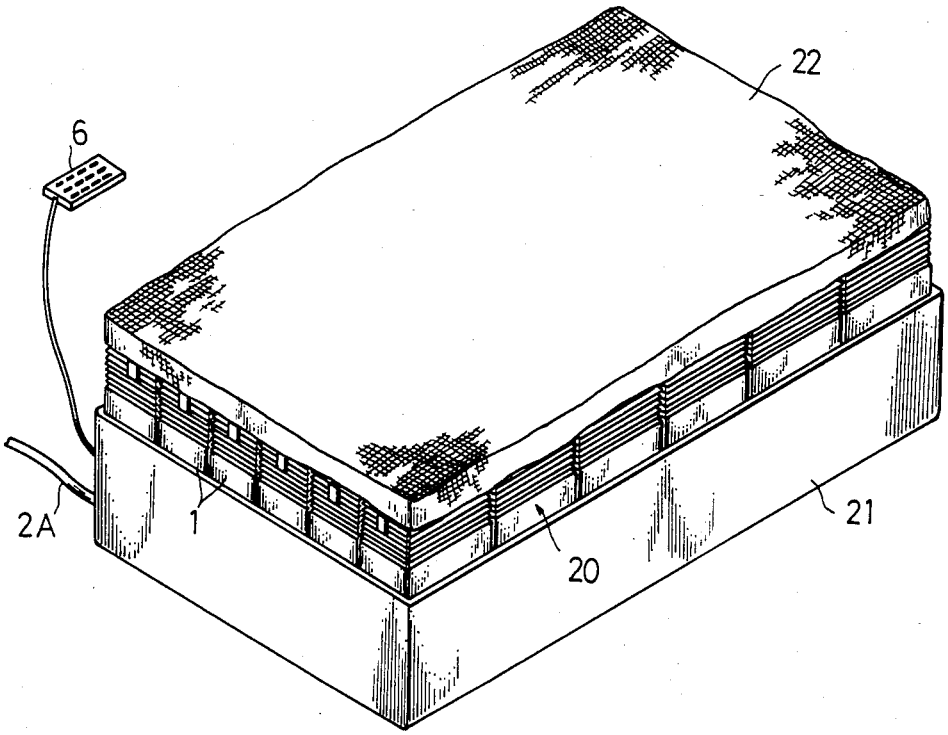
FIG. 3 is a perspective view of a bed embodiment of the present invention.

A plurality of mat units are secured toa base 21 adjacent to one another as illustrated in FIG. 3 with known adhesive, thereby forming mat body 20 on base 21. Additionally, a mattress 22 is laid over the mat body 20, to prevent an individual lying in bed from being directly subjected to inflating and deflating motion of the individual mat units 1.

Figure 2:
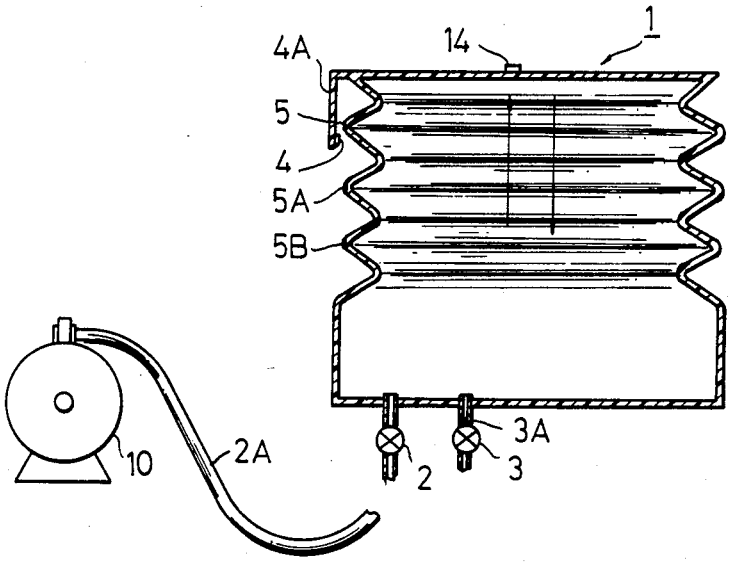
FIG. 2 is a sectional view taken along line II—II in FIG. 1.

Mat units 1 illustrated in FIGS. 1 and 2 are each provided with electromagnetic valves 2 and 3. However, the structure illustrated in FIG. 3 is one embodiment of the present invention in which, when a plurality of mat units 1 are intended to be fixed to base 21, 3 to 4 individual mat units 1 are merged into a larger unit, and the larger units thus formed communicate with each other by means of feeding pipes 2A and exhaust pipes 3A, so that only two electromagnetic valves 2 and 3 operate jointly, to control air quantity in a plurality of larger mat units.

Figure 4:
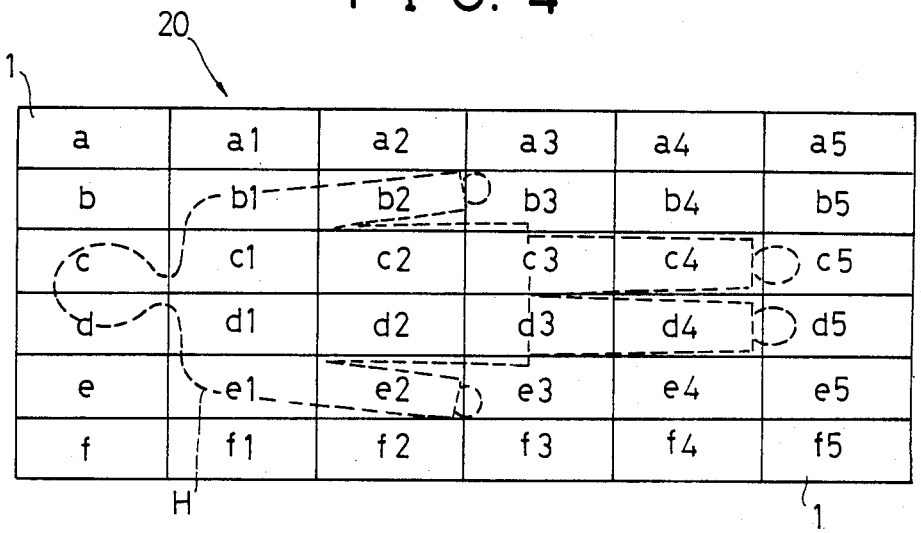
FIG. 4 is a schematic view illustrating the relationship between movement of individual mat units when operated by control means, and position of an individual lying in bed.

The embodiment of the structure noted above operates in the following manner:

FIG. 4 is a plan view of a mat body 20, in which reference characters a, b, c, d, e and f indicate transverse arrangement of mat units 1, while reference characters $a_1$, $a_2$, . . . $b_1$, $b_2$, . . . $c_1$, $c_2$, . . . etc. indicate longitudinal arrangement of mat units 1. An individual lying in bed is illustrated by the dotted line, indicating such an individual H positioned with the head on mat units c and d. When such an individual H is supposed to be lying on his side, all mat units in the row of a ($a_1$, $a_2$, $a_3$ . . . ) and b ($b_1$, $b_2$, $b_3$ . . . ) are inflated to raise the left side of the individual H lying on his back and enable the individual H to lie on his right side. When mat units in the row of c ($c_1$, $c_2$, $c_3$ . . . ) are inflated to a further extent, the individual H is enabled to lie on his face.

In order to prevent an individual H from lying on his face, air is additionally fed into mat units 1 in the row of f ($f_1$, $f_2$, $f_3$ . . . ) so that these mat units 1 are inflated to the level equal to that of the mat units 1 in the rows of a and b. The function of raising the upper half of the body of an individual lying on his back, is accomplished by feeding air into mat units 1 in the row a, b, c, d, e and f in a quantity sufficient for inflating these units 1 to the highest level possible, and by feeding air into mat units 1 in the rows of $a_1$, $b_1$, $c_1$, $d_1$, $e_1$, and $f_1$ in a quantity slightly smaller than the quantity in rows a to f inclusive. However, since air quantity to be fed varies according to degree of angle at which the body of an individual is raised, values of required quantity of air should be stored in the control device 6.

An example of the manner of using a bed of an embodiment of the present invention has been described above, from which it is apparent that a desirable air quantity to be fed into an individual mat unit differs according to the posture and bodily form of an individual lying on the bed. Therefore, by adapting the control device 6 to store values of air quantity to be fed into mat units 1 which correspond to a plurality of variations in posture and bodily form of an individual lying on the bed, a bed according to the present invention is applicable to an individual lying thereon in any posture or bodily form, or to any posture that an individual lying on the bed desires to assume.

An arrangement of a plurality of mat units 1 in a plane enables gradual change of the level of each mat unit 1 with the concommitant feeding and/or discharging of air thereinto and therefrom, whereby even the physically handicapped or the seriously bedridden can be turned over in bed in any desired position, without being subjected to pain, even more gently and safely than being turned over with a helper's hand.

Figure 5:
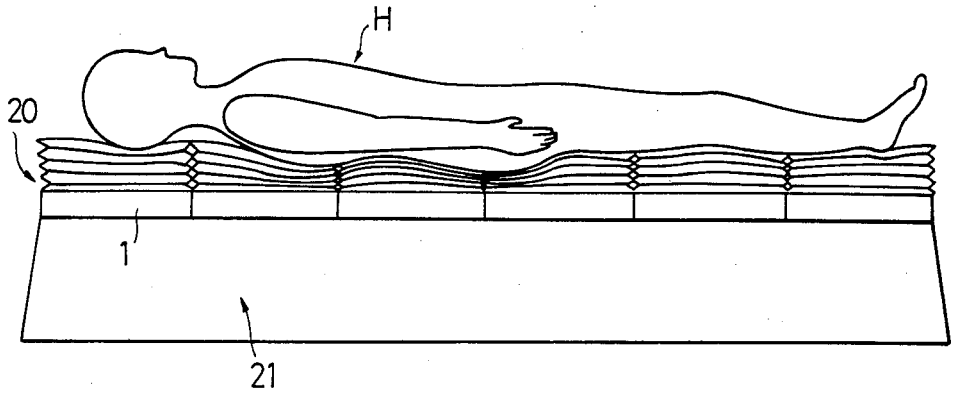
FIG. 5 is an explanatory view for describing action of an individual mat unit.

Especially in the present invention, because of the bellows-type structure of the individual mat unit 1, the bellows freely bend as if undulating according to the posture of an individual H lying on the mat body 20, as illustrated in FIG. 5, thereby providing an extremely snugly-accommodating bed.

Furthermore, when a centralized control is employed over a large number of beds according to the present invention through control devices, centralized care in a hospital is possible and patients lying in bed may be automatically turned over at certain time intervals, even during the night.

A second embodiment of the present invention is now described, with reference to FIGS. 6–11. In FIGS. 6–11, a mat unit 30 is also formed of bellows-type structure, similar to the first embodiment described above. Mat unit 30 is internally provided with a receiving table 34 at the bottom 30A thereof, for supporting and preventing the mat unit 30 from deflating beyond a fixed limit. Receiving table 34 is composed of an elastic material such as synthetic rubber.

Figure 6:
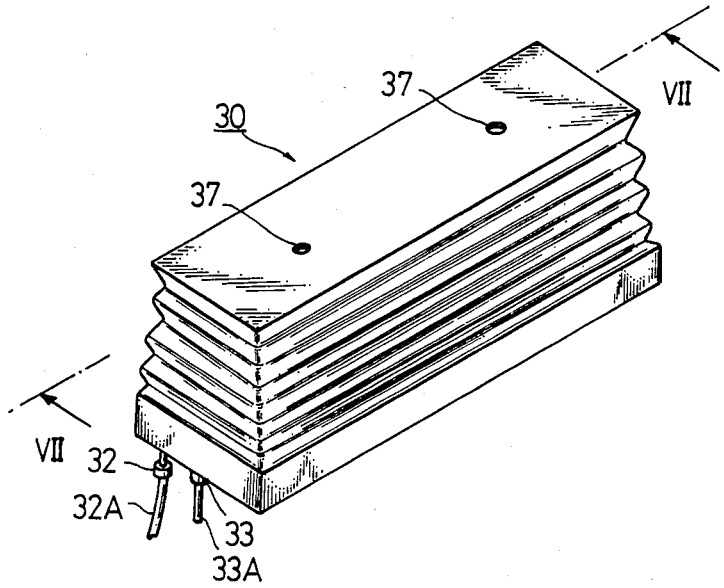
FIG. 6 is a perspective view of another mat unit embodiment of the present invention.
Figure 7:
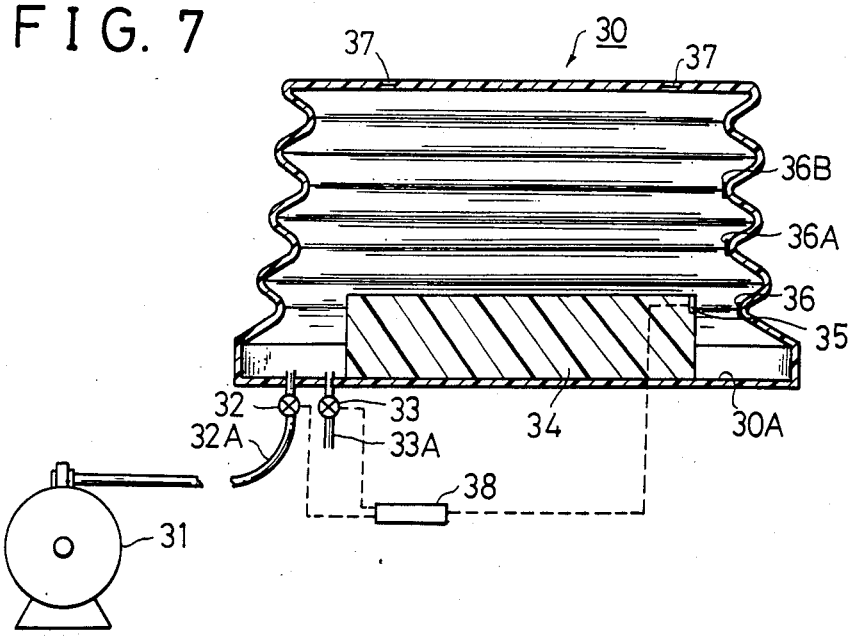
FIG. 7 is a sectional view taken along line VII—VII in FIG. 6.

Mat unit 30, of an air-tight bellow type structure, is in trapezoidal shape in cross section, slightly tapering to the top as best seen in FIGS. 6 and 7. A valve 32 is also fixed in this embodiment to an air feeding pipe 32A which is in turn connected to mat unit 30 at one end and to a compressor 31 at its other end, in order to blow air into mat unit 30 through the valve 32 by means of a control device 38, which is for example a computer. An exhaust valve 33 is connected to mat unit 30 at one end and to an exhaust pipe 33A at its other end. Exhaust pipe 33A is open to the atmosphere at its end opposite exhaust valve 33, so that exhaust flow from mat unit 30 or stoppage thereof is directed by control device 38.

A photoelectric sensor 35 is fixed to the upper side surface of the receiving table 34. A plurality of reflective members 36, 36A and 36B are secured to the inner side surface of mat unit 30 at predetermined intervals. Therefore, when the bellows-type mat unit 30 is inflated or deflated, photoelectric sensor 35 will detect locations of reflective members 36, 36A and 36B provided on bulbing parts of the inner side of mat unit 30, and actuate, if necessary, air feeding valve 32 and exhaust valve 33 through control device 38, so that levels of individual mat units 30 are adjusted by either blowing compressed air fed from the compressor 31 into the individual mat units 30, or discharging air from the individual mat units 30 as required.

Figure 8:
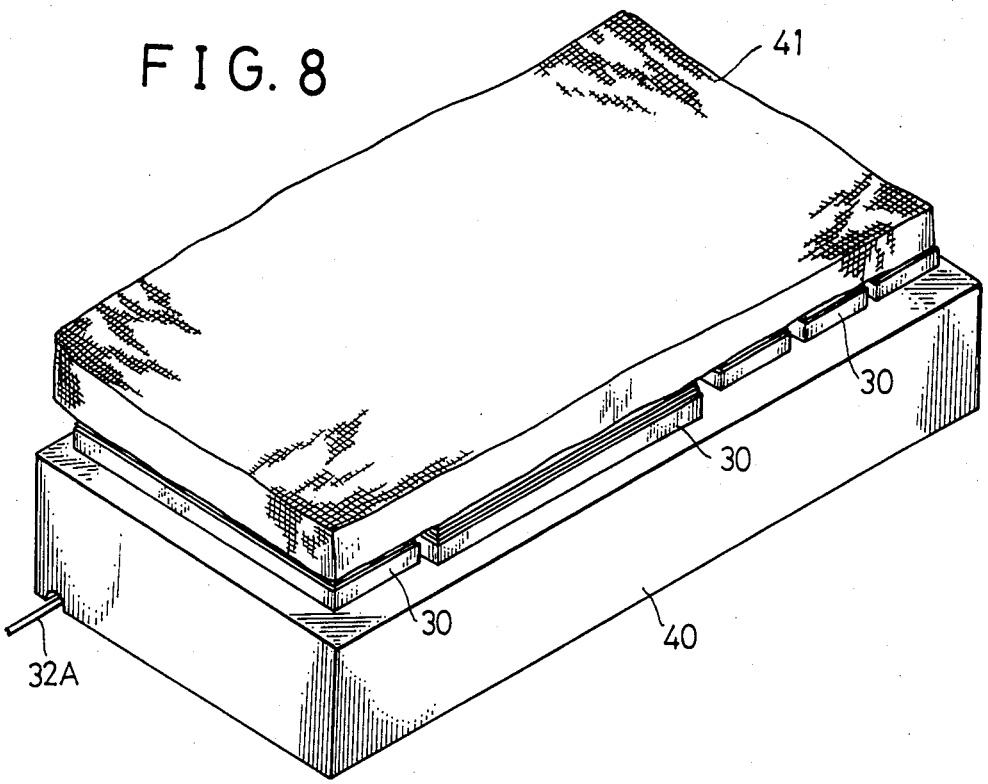
FIG. 8 is a perspective view of a further bed embodiment of the present invention.
Figure 9:
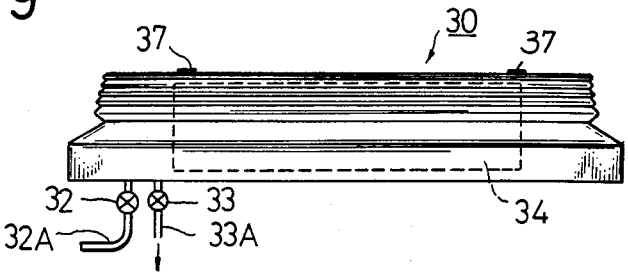
FIGS. 9 and 10 are views illustrating operation of a mat unit embodiment of the present invention.
Figure 10:
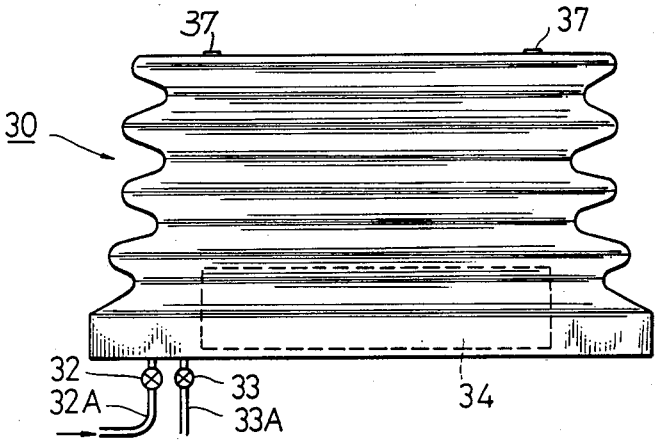
Figure 11:
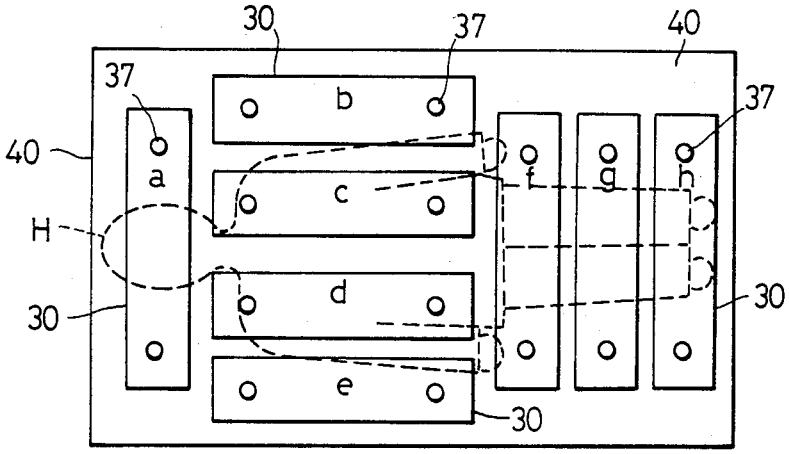
FIG. 11 is a plan view illustrating mat units mounted on a base of a bed, in which an individual lying on the bed is indicated by a dotted line.

A plurality of sensors 37 (two such sensors are specifically illustrated in FIGS. 6, 7, 9 and 10) are provided on each mat unit 30 for the purpose of contact-sensing to detect posture of an individual lying in bed. Sensors 37 are adapted to be functional for remote operation of beds under collective control, to be described further below. A plurality of mat units 30 in this embodiment are secured to the base 40 as illustrated in FIGS. 8 and 11 with adhesive, thereby forming a bed to accommodate an individual. An overlaid mattress is denoted by numeral 41 in FIG. 8. This embodiment operates in the following manner:

FIG. 11 is a plan view of a plurality of mat units 30 disposed on the base 40, in which reference characters a to h indicate mat units 30 according to the portion of the body of an individual H lying on the bed (illustrated by the dotted line in the drawing) as follows: a, head; b, left shoulder; c and d, central upper portion of the back; e, right shoulder; f, hip; g, thigh; and h, leg. An appropriate quantity of air is normally contained in each mat unit 30. When it is desired to change the position of an individual lying on his back, to a position where the individual is lying on his right side in the bed, mat unit 30 in position b is inflated by air blown thereinto, to become large in height. By inflating mat unit 30 in position b, and by deflating mat units 30 in positions c and d, an individual lying on the bed is turned over onto his right side. For raising the upper half of the body of an individual lying on his back, air is blown into mat units 30 in position a, b, c, d and e.

Thus, according to the quantity of air blown into a plurality of mat units 30 secured to the base 40, and quantity of air released from individual mat units 30 secured to base 40, posture of an individual lying on the bed over these various mat units 30, can be changed in a variety of ways. Furthermore, in this particular embodiment of FIGS. 6–11, the approximate trapezoidal cross-sectional shape of the individual mat unit 30 (FIGS. 6 and 8) ensures a more stable operation to inflate or deflate the individual mat unit 30.

As has been previously described, according to the present invention a revolutionary bed is provided which, among the other advantages noted above, is also effective for preventing bed sores from bothering those who are incapable of changing posture by themselves while lying in bed, such as the physically handicapped confined to bed, the sick, and the elderly.

The preceding description of the present invention is merely exemplary and is not intended to limit the scope thereof in any way.

What is claimed is:

1. A mat unit comprising a hollow, fluid-tight bellows;

a fluid feeding pipe connected at one end to said bellows;

a valve disposed in said fluid feeding pipe to control fluid quantity fed into said bellows;

an exhaust pipe connected at one end to said bellows and opened to the atomosphere at the other end thereof;

a second valve disposed in said exhaust pipe to control fluid quantity discharged from said bellows;

a supply source of pressurized fluid connected to the other end of said fluid feeding pipe; and sensing means for detecting fluid quantity in said bellows, comprising a member suspended from an upper part of said bellows;

a photoelectric sensor disposed on said suspended member; and a plurality of reflective members disposed on an outer side of said bellows, said reflective members disposed to lie opposite said photoelectric sensor at predetermined intervals.

2. The mat unit of claim 1 additionally comprising a second sensor disposed on an upper surface of said bellows for contact sensing.

3. The mat unit of claim 2 in which said bellows has an approximately trapezoidal cross-section.

4. A mat unit comprising a hollow, fluid-tight bellows;

a fluid feeding pipe connected at one end to said bellows;

a valve disposed in said fluid feeding pipe to control fluid quantity fed into said bellows;

an exhaust pipe connected at one end to said bellows and opened to the atmosphere at the other end thereof;

a second valve disposed in said exhaust pipe to control fluid quantity discharged from said bellows;

a supply source of pressurized fluid connected to the other end of said fluid feeding pipe; and sensing means for detecting fluid quantity in said bellows, comprising a receiving table disposed on an inner bottom of said bellows;

a photoelectric sensor disposed on a side of said receiving table; and a plurality of reflective members disposed on an inner side of said bellows, said reflective members disposed to lie opposite said photoelectric sensor at predetermined intervals.

5. The mat unit of claim 4 additionally comprising a second sensor disposed on an upper surface of said bellows for contact sensing.

6. The mat unit of claim 5 in which said bellows has an approximately trapezoidal cross-section.

7. A method for adjusting position of a bedridden individual in bed, which comprises the steps of:

disposing a plurality of discrete mat units on a base of said bed, each discrete mat unit disposed to be inflatable/deflatable with pressurized fluid to expand/contract to a certain desired level, adjusting the desired level of each discrete mat unit by inflating/deflating said individual mat unit to the desired level to adjust position of the individual disposed on said bed, and sensing position of each individual mat unit by disposing a photoelectric sensor to sense the position, disposing a plurality of reflective members on each of said mat units, and causing each of said reflective members to lie opposite said photoelectric sensor depending on the level to which said individual mat unit is inflated/-deflated.

8. The method of claim 7 which comprises disposing said photoelectric sensor outside said mat unit, and disposing said reflective members on an outer side of said mat unit.

9. The method of claim 7 which comprises disposing said photoelectric sensor inside said mat unit, and disposing said reflective members on an inner side of said mat unit.

10. The method of claim 7 which comprises the additional step of sensing contact of the individual with the bed by means of at least one additional sensor disposed on an upper surface of each of said mat units.

* * * * *